US009078532B1

(12) United States Patent
McHatet

(10) Patent No.: US 9,078,532 B1
(45) Date of Patent: Jul. 14, 2015

(54) CIRCULAR LOCK ASSEMBLY

(71) Applicant: Hamid McHatet, Miami, FL (US)

(72) Inventor: Hamid McHatet, Miami, FL (US)

( * ) Notice: Subject to any disclaimer, the term of this patent is extended or adjusted under 35 U.S.C. 154(b) by 0 days.

(21) Appl. No.: 14/149,490

(22) Filed: Jan. 7, 2014

(51) Int. Cl.
*E05B 73/00* (2006.01)
*A47F 5/08* (2006.01)

(52) U.S. Cl.
CPC ..... *A47F 5/0861* (2013.01); *E05B 73/00* (2013.01)

(58) Field of Classification Search
CPC ... A47F 5/0861; A47F 7/024; E05B 73/0017; E05B 73/0064; E05B 73/0005; E05B 69/006; E05B 73/00
USPC ..... 70/57.1, 14, 57, 58, 62, 64, 46, 52; 248/220.21, 220.22, 221.11, 222.11, 248/222.51; 211/7, 57.1, 59.1
See application file for complete search history.

(56) References Cited

U.S. PATENT DOCUMENTS

| | | | | |
|---|---|---|---|---|
| 5,275,027 | A * | 1/1994 | Eklof et al. | 70/14 |
| 5,624,040 | A | 4/1997 | Hono | |
| 5,711,432 | A | 1/1998 | Stein et al. | |
| 5,996,817 | A | 12/1999 | Kao | |
| 6,076,669 | A | 6/2000 | Ling | |
| 6,837,373 | B2 | 1/2005 | Huang | |
| 6,854,594 | B2 | 2/2005 | Vasudeva et al. | |
| 6,957,555 | B1 | 10/2005 | Nagel et al. | |
| 7,137,513 | B2 | 11/2006 | Sedon et al. | |
| 7,269,983 | B1 * | 9/2007 | Mchatet et al. | 70/14 |
| 7,350,645 | B1 | 4/2008 | Sills | |
| 7,624,871 | B2 | 12/2009 | Sills | |
| 2005/0230587 | A1 | 10/2005 | Yang | |
| 2007/0289344 | A1 * | 12/2007 | Fawcett et al. | 70/58 |
| 2008/0169250 | A1 * | 7/2008 | Nagelski | 211/7 |
| 2010/0223965 | A1 * | 9/2010 | Richardson et al. | 70/58 |

FOREIGN PATENT DOCUMENTS

EP 2215934 A2 * 8/2010

* cited by examiner

*Primary Examiner* — Lloyd Gall
*Assistant Examiner* — Amanda L Miller
(74) *Attorney, Agent, or Firm* — Albert Bordas, P.A.

(57) ABSTRACT

A lock assembly having a front housing with a locking member. The front housing houses a spring. A slider assembly has a locking ramp. The locking ramp is engaged by the locking member when the slider assembly is in a locked configuration. A cover plate assembly has a transversal opening. The transversal opening receives a transversal member of a rail assembly when the slider assembly is in an unlocked configuration. The slider assembly has a locking tab that blocks the transversal opening when the slider assembly is in the locked configuration. Thus, securing the transversal member to prevent removal of packaging suspended from the rail assembly. A key inserted into a keyhole, is rotated to cause the locking ramp to disengage from the locking member to place the slider assembly is in the unlocked configuration.

17 Claims, 6 Drawing Sheets

CIRCULAR LOCK ASSEMBLY

BACKGROUND OF THE INVENTION

1. Field of the Invention

The present invention relates to lock assemblies, and more particularly, to a circular lock assembly that secures products displayed on a look hoop system to prevent theft and misplacement.

2. Description of the Related Art

Retailers lose more than $33 billion annually due to inventory shrinkage that typically results from theft and misplacement. Reducing inventory shrinkage is an important store management issue that must be addressed to achieve and maintain a successful operation. In an effort to increase owner profits, retailers have a need for an easy, simple, and inexpensive lock assembly to secure products displayed on a look hoop system to help prevent theft and product misplacement.

Applicant believes that one of the closest references corresponds to Applicant's own U.S. Pat. No. 7,269,983 issued on Sep. 18, 2007 for a lock assembly. However, it differs from the present invention because Applicant then taught a lock assembly including a lock, a key and a rail assembly. The lock includes a lock housing and an actuating housing. The lock housing includes a rear notch, an internal notch that houses a spring and a locking tab, and an aperture that houses a second spring. A vertical track member is mounted to the rear notch and it has a vertical cutout. The actuating housing includes rear, lateral and top walls and a protrusion with a notch. The actuating housing is slidably mounted to the lock housing with a pin. The rail assembly is mounted to racks in stores wherein products for display are mounted thereto. The lock mounts onto the rail assembly by inserting the transversal member of the rail behind the protrusion and pressing the actuating housing against the lock housing until the locking tab engage into the notch.

Applicant believes that another reference corresponds to U.S. Patent Application Publication No. 20050230587 A1, published on Oct. 20, 2005 to Yang for a display device for article for sale. However, it differs from the present invention because Yang teaches a display device including a plug device having a housing engageable into a hole of an article for sale. The housing includes a chamber and a spring blade having a projection to engage into a depression of the article, and for detachably attaching the housing to the article. A hanger device includes an actuator engageable into the chamber of the housing, to selectively engage with the spring blade of the housing, and to force and retain the projection of the spring blade within the depression of the article, and thus to detachably lock the housing to the article with the actuator of the hanger device. A locking device may be used to lock the actuator of the hanger device to the housing of the plug device.

Applicant believes that another reference corresponds to U.S. Pat. No. 7,624,871 B2 issued to Sills on Dec. 1, 2009 for a product security system for hanging merchandise. However, it differs from the present invention because Sills teaches a security system for preventing theft of hanging merchandise including a security package system for a product to be placed on a hanging display, the package comprising: (a) a product package of a relatively thin plastic material and having a top portion which has a front and rear, the top portion having an aperture adapted to receive a hang support; (b) a locking member of a relatively thick plastic material and having a front and rear portion so as to removably fit over the top portion of the product package and having apertures in the front and rear portions that are positioned so as to align with the aperture of the top portion when in position over the top portion.

Applicant believes that another reference corresponds to U.S. Pat. No. 7,350,645 B1 issued to Sills on Apr. 1, 2008 for a product security system for hanging merchandise. However, it differs from the present invention because Sills teaches a security system for preventing theft of hanging merchandise including a security package system for a product to be placed on a hanging display, the package comprising: (a) a product package of a relatively thin plastic material and having a top portion which has a front and rear, the top portion having an aperture adapted to receive a hang support; (b) a locking member of a relatively thick plastic material and having a front and rear portion so as to removably fit over the top portion of the product package and having apertures in the front and rear portions that are positioned so as to align with the aperture of the top portion when in position over the top portion.

Applicant believes that another reference corresponds to U.S. Pat. No. 7,137,513 B2, published on Nov. 21, 2006 to Sedon, et al. for a merchandise display system. However, it differs from the present invention because Sedon, et al. teaches a merchandise display system that includes a rod lockably connected to a peg-board, a hanging member hanging from the rod and a swivel member rotatably connected to the hanging member about a first axis. The swivel member is connected to a lockable display case for carrying an item of merchandise and is rotatable about a second axis perpendicular to the first axis. Thus, the display case is rotatable about the first and second axes to facilitate viewing the merchandise from any angle while the case is lockably connected to the rod. The hanging and swivel members may be a ball and socket combination. Alternately, the swivel member may connect to the display case via a hinge pin about which portions of the case may rotate to open and close. Alternately, a lower member may extend from within the case through holes therein to rotatably connect to the swivel member about the second axis.

Applicant believes that another reference corresponds to U.S. Pat. No. 6,957,555 B1 issued to Nagel, et al. on Oct. 25, 2005 for a locking attachment for product display hooks. However, it differs from the present invention because Nagel, et al. teaches a merchandise locking device for retrofit attachment to a product display hook installed on a merchandise display panel. The locking device attaches without tools to the upper wire arm of the display hook for pivoting movement between "lock" and "open" positions. A laterally opening recess in the locking device receives the lower arm of the display hook and a locking arm, rotatably mounted in the body of the locking device by a rotor element, closes the recess to lock the device to the lower arm and prevent the removal of merchandise therefrom. A simple key carried by store personnel enables the rotor to be released to free the locking device from the lower arm and permit the removal of merchandise. The locking device consists of four elements, including the key, and can be manufactured at very low cost, suitable for mass merchandise applications. Simple changes in rotor components enable the locking device to be operated by different keys, which may be color-coded with the locking devices or components thereof. A bracket is also provided for retrofit attachment to the display hook, to prevent bodily removal of the hook and its contents from the display panel.

Applicant believes that another reference corresponds to U.S. Pat. No. 6,854,594 B2 issued to Vasudeva, et al. on Feb. 15, 2005 for a product holder with point-of-sale security. However, it differs from the present invention because Vasudeva, et al. teaches a point-of-sale security system that includes a container for containing the product and a holder assembly, the holder assembly including a closure device for closing the container. The holder assembly and the container are operatively coupled together by means of cooperative members. The cooperative members being configured in a special way, i.e., when an associated stop member is enabled, the cooperative members prevent decoupling of the holder assembly from the container, and when the stop member is disabled, the cooperative members enable decoupling of the holder assembly from the container.

Applicant believes that another reference corresponds to U.S. Pat. No. 6,837,373 B2 issued to Huang on Jan. 4, 2005 for a tool suspension device with a burglarproof feature. However, it differs from the present invention because Huang teaches a tool suspension device for pliers having a suspension board and a bracket. The suspension board has a front, a rear, a clip and a removable locking stub. The clip is mounted on the rear of the suspension board. The removable locking stub is attached to the front of the suspension board. The bracket is mounted on the front of the suspension board and has a U-shaped frame and clamping arms inside the frame. A tool slot is defined vertically through the frame and is adapted to hold a tool that is positioned head down. The removable locking stub prevents upward movement of the tool to prevent the tool from being easily pulled out of the tool slot to steal. The clip is used to hang the tool suspension device on a person's belt.

Applicant believes that another reference corresponds to U.S. Pat. No. 6,076,669 B1 issued to Ling on Jun. 20, 2000 for a tool display rack. However, it differs from the present invention because Ling teaches a tool display rack including a body with a first engaging member extending from the first end thereof in which a first aperture is defined, a limiting member connected to the body at its first end by a connecting plate and having a recess defined therein, a second engaging member extending from the second end of the limiting member so as to engage with the first aperture, a second aperture defined in the second end of the limiting member so as to receive the first engaging member so that a tool extends through the recess between the body and the limiting member and is limited by the limiting member. The tool can only be taken away from the body by cutting the second engaging member extending through the first aperture in the body.

Applicant believes that another reference corresponds to U.S. Pat. No. 5,996,817 B1 issued to Kao on Dec. 7, 1999 for a tool suspension rack assembly. However, it differs from the present invention because Kao teaches a suspension rack having a base plate defining at least one hole, at least one suspension plate defining a slot, and at least one fastener member including an abutting plate abutting a first side of the suspension plate. A lug extends from the abutting plate and is received in the slot. A snapping member having a stub extends from the lug and is received in the hole. An enlarged cone-shaped head extends from the stub and abuts a second side of the base plate.

Applicant believes that another reference corresponds to U.S. Pat. No. 5,711,432 B1 issued to Stein, et al. on Jan. 27, 1998 for a pilfer-resistant peg hook assembly. However, it differs from the present invention because Stein, et al. teaches a pilfer-resistant peg hook assembly for supporting a plurality of articles incorporating defined slots and enabling only one article at a time to be removed therefrom and formed of a peg hook and a flipper. The peg hook has a pair of opposed ends and a body connecting the same. One of the hook ends is configured and dimensioned to maintain the hook body in a substantially horizontal first plane when mounted on an appropriate surface, and the other of the hook ends is a free end. The hook body is configured and dimensioned to be received in the slots of the articles and extends only in the first plane. The flipper is pivotably secured adjacent the free end and is movable between an enabling orientation enabling at least partial passage of an article along the hook body and onto the flipper as the article initially moves towards the free end, and a blocking orientation precluding passage of an article onto the flipper as the article moves towards the free end. The flipper is cammed into the blocking orientation as the article continues to pass over the flipper towards the free end.

Applicant believes that another reference corresponds to U.S. Pat. No. 5,624,040 B1 issued to Hono on Apr. 29, 1997 for a theft-preventive display hook system. However, it differs from the present invention because Hono teaches a security system for a display rack in which merchandise in packages is threaded through an opening in the packaging over a free end of a hanger rod for display. The free end of the hanger rod is threaded, and a threaded cap is treated onto the free end of the rod to prevent removal of the package. The cap has a pair of opposed grooves, and a special key is provided to remove the cap.

Applicant believes that another reference corresponds to U.S. Pat. No. 5,275,027 B1 issued to Eklof, et al. on Jan. 4, 1994 for a security device for merchandise display hooks. However, it differs from the present invention because Eklof, et al. teaches a security device for use on pegboard type hooks. The device includes a housing with a lock mechanism, which releasably locks with the tines of a latch to securely grip the rod of the pegboard hook. A simple key-operated camming cylinder is manually operated to release the latch so that merchandise products carried on hook can be removed. The latch can be inserted into the housing and relocked on the hook without using the key.

Other patents describing the closest subject matter provide for a number of more or less complicated features that fail to solve the problem in an efficient and economical way. None of these patents suggest the novel features of the present invention.

SUMMARY OF THE INVENTION

The present invention is a lock assembly, comprising a front housing having a locking member and a keyhole, and the front housing houses a spring. A slider assembly comprises a locking ramp. The locking ramp is engaged by the locking member when the slider assembly is in a locked configuration. A cover plate assembly comprises a transversal opening. The transversal opening receives a transversal member of a rail assembly when the slider assembly is in an unlocked configuration. The present invention also comprises a key.

The slider assembly comprises a locking tab that blocks the transversal opening when the slider assembly is in the locked configuration. Thus, securing the transversal member to prevent removal of packaging suspended from the rail assembly. The rail assembly comprises rail members kept at a spaced apart relationship with respect to each other by the transversal member.

Once the key is inserted into the keyhole, the key is rotated to cause the locking ramp to disengage from the locking member to place the slider assembly in the unlocked configuration. More specifically, the key is rotated to displace/deflect the locking ramp, causing release of the locking ramp from the locking member.

The spring is mounted onto a spring base of the front housing and onto a spring post of the slider assembly. The spring comprises a spring force to keep the slider assembly in the unlocked configuration. The spring force is overcome to place the slider assembly in the locked configuration. The slider assembly is positioned in between the front housing and the cover plate.

The cover plate assembly comprises a key alignment hole to receive a distal end of the key. The cover plate assembly also comprises a neck that extends from the transversal opening. The neck receives the locking tab to block the transversal opening when the slider assembly is in the locked configuration.

The slider assembly further comprises a slider frame. Extending from the slider frame are first and second arms. The first and second arms each have a respective end and each end has a respective lock tab. Also extending from the slider frame is a slider column and the locking tab.

It is therefore one of the main objects of the present invention to provide a circular lock assembly that secures products displayed on a look hoop system to prevent theft and misplacement.

It is another object of this invention to provide a circular lock assembly that can be readily mounted and unmounted without the need of any tools.

It is another object of this invention to provide a circular lock assembly that minimizes locking and unlocking time.

It is another object of this invention to provide a circular lock assembly that is volumetrically efficient for carrying, transporting, and storage.

It is another object of this invention to provide a circular lock assembly, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
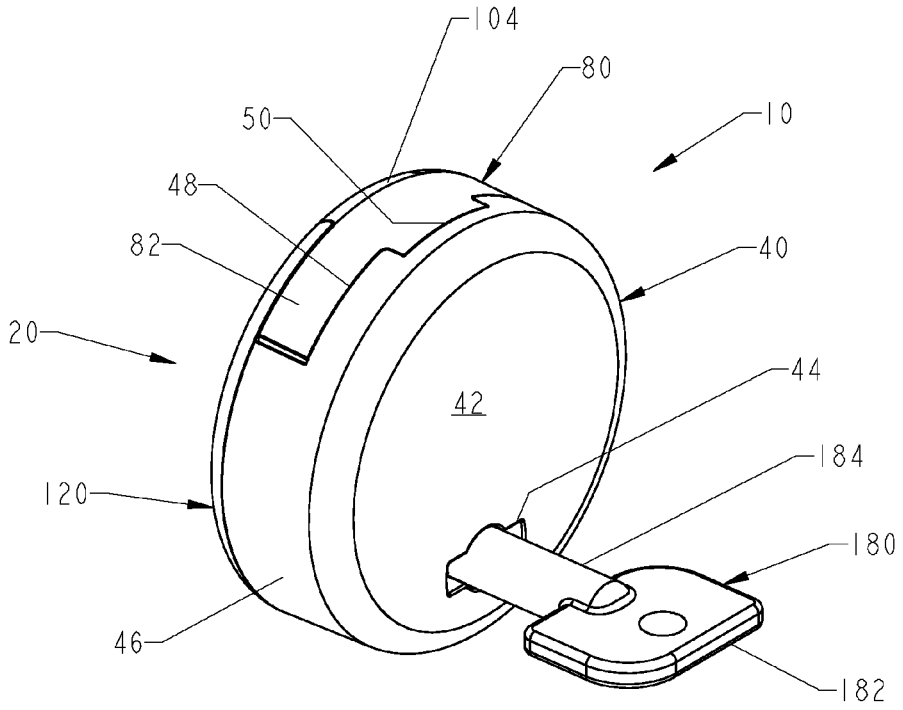
FIG. 1 represents a front isometric view of a circular lock assembly in a locked position.

Referring now to the drawings, the present invention is a circular lock assembly and is generally referred to with numeral 10. It can be observed that it basically includes lock assembly 20 and key 180. Circular lock assembly 10 is used with rail assemblies 200, usually mounted to display racks in stores, not shown, to prevent removal of packaging suspended therefrom.

As seen in FIGS. 1, 2, 3, and 4, lock assembly 20 comprises front housing 40, slider assembly 80, and cover plate assembly 120.

Figure 2:
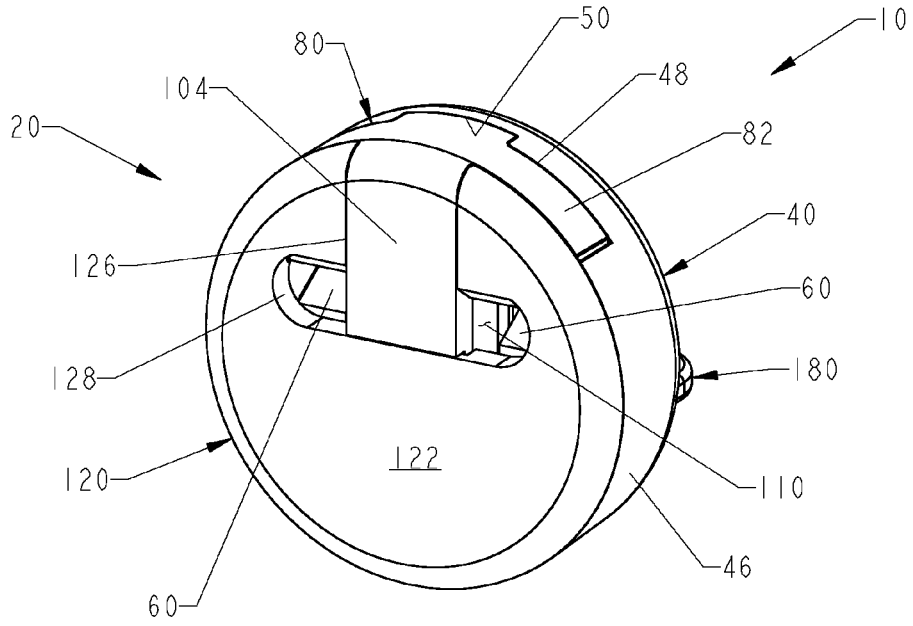
FIG. 2 represents a rear isometric view of the circular lock assembly seen in FIG. 1, in the locked position.
Figure 3:
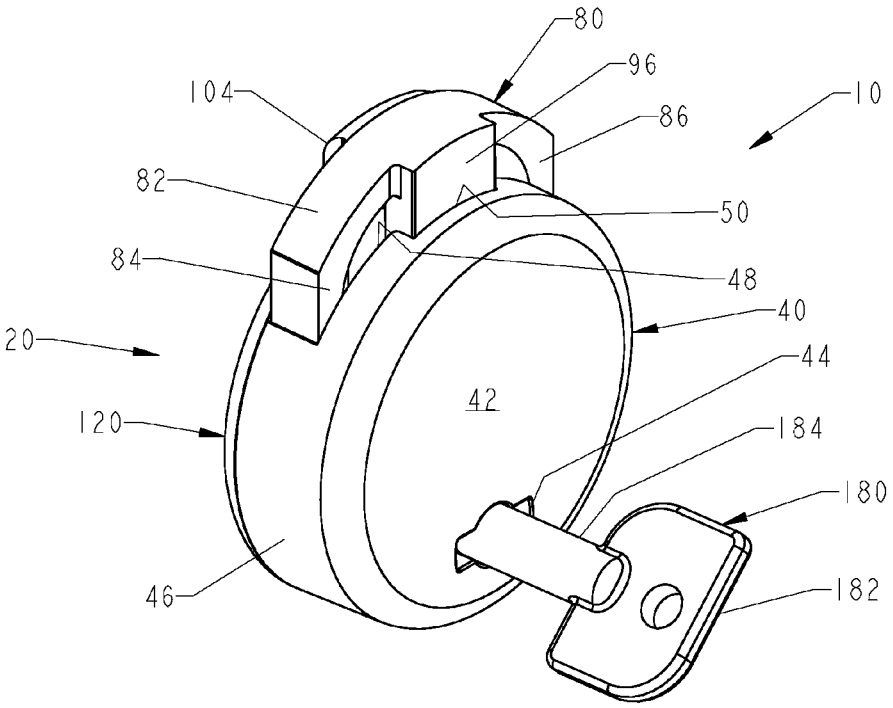
FIG. 3 represents a front isometric view of the circular lock assembly seen in FIG. 1, in an unlocked position.
Figure 4:
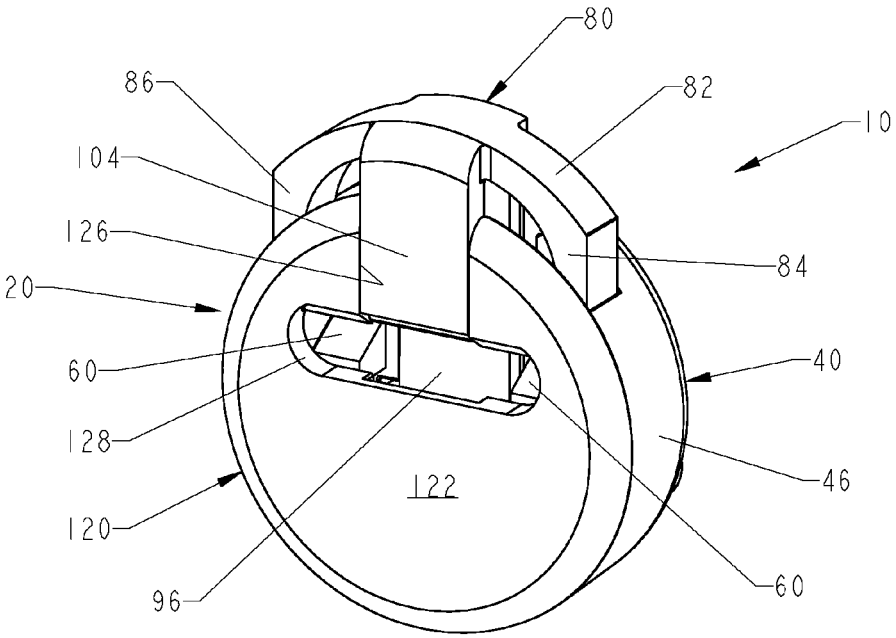
FIG. 4 represents a rear isometric view of the circular lock assembly seen in FIG. 2, in the unlocked position.

Front housing 40 has front wall 42 with keyhole 44. Keyhole 44 has a cooperative dimension and shape to removably receive key 180 therethrough. Front housing 40 also has sidewall 46 with cutout 48 and notch 50. Slider assembly 80 is sandwiched in between front housing 40 and cover plate assembly 120. As best seen in FIGS. 3 and 4, slider assembly 80 basically comprises slider frame 82, arms 84 and 86, slider column 96, and locking tab 104. As best seen in FIGS. 2 and 4, cover plate assembly 120 has neck 126 that connects to transversal opening 128. As best seen in FIG. 3, neck 126 and transversal opening 128 cooperatively receive locking tab 104 of slider assembly 80 while cutout 48 receives arms 84 and 86, and notch 50 cooperatively receives slider column 96.

As best seen in FIG. 4, key 180 actuates to unlock lock assembly 20. When lock assembly 20 is unlocked, slider assembly 80 is released to partially protrude outwardly from housing 40 and cover plate assembly 120, thus opening transversal opening 128.

Figure 5:
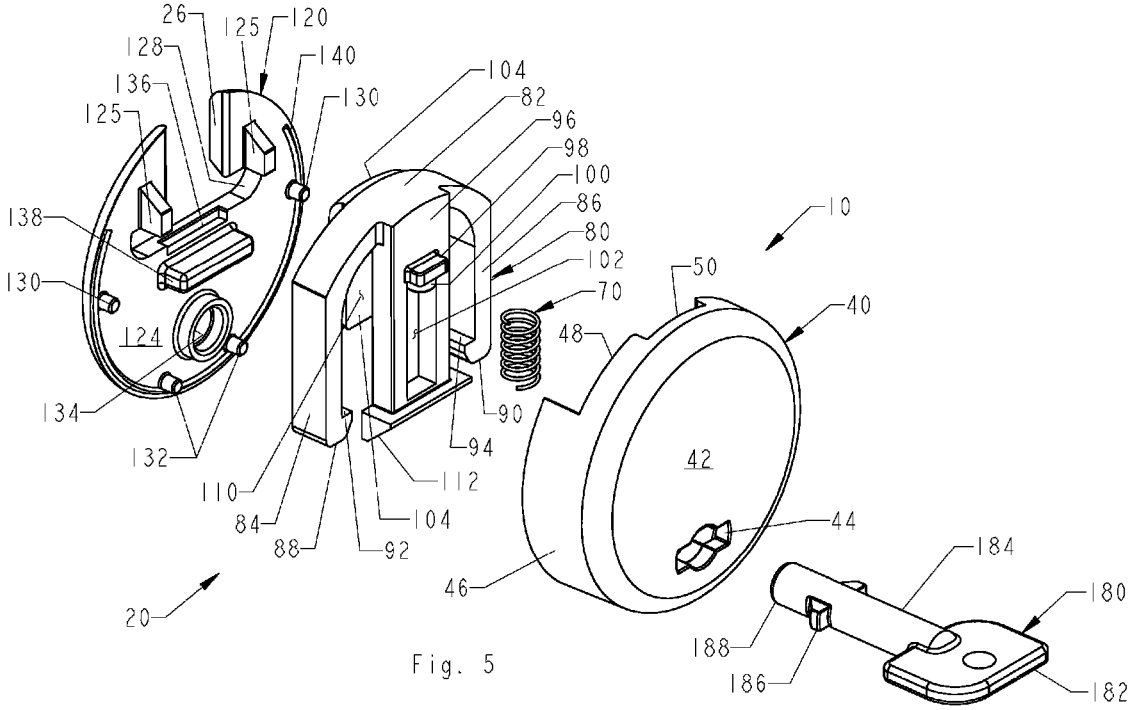
FIG. 5 is an exploded front isometric view of the circular lock assembly.
Figure 6:
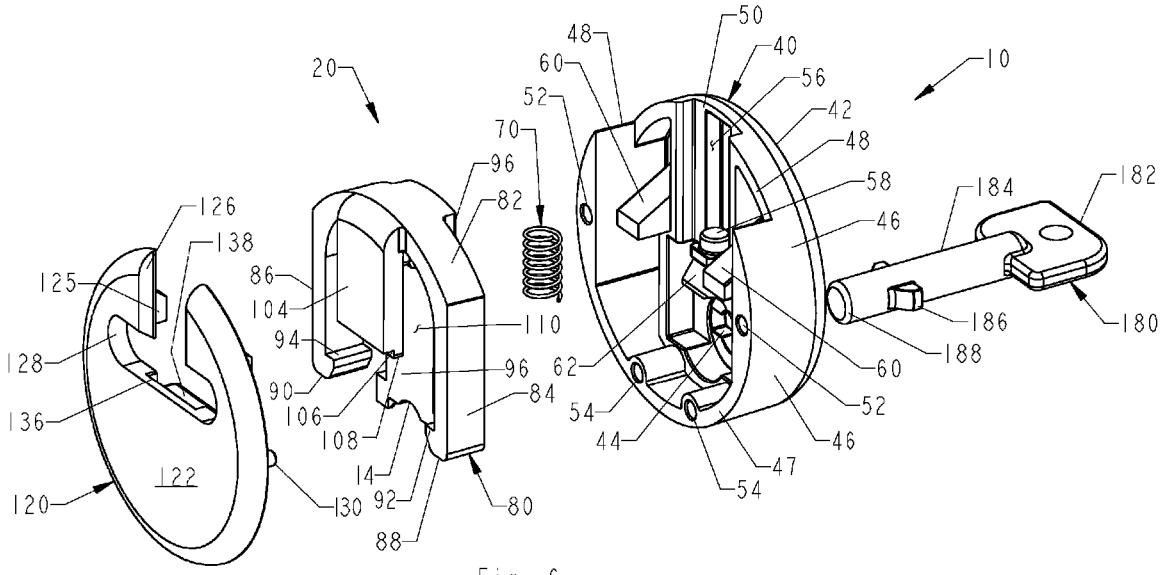
FIG. 6 is an exploded rear isometric view of the circular lock assembly.

As seen in FIGS. 5 and 6, sidewall 46 extends from front wall 42 to edge 47. Front housing 40 further comprises spring channel 56 extending inwardly a predetermined distance from notch 50. Spring channel 56 has spring base 58 at its end. Holes 52 and 54 are cooperatively disposed at edge 47 of sidewall 46. Front housing 40 further comprises guide members 60 and locking member 62.

Spring 70 is mounted to spring base 58 and is partially housed inside spring channel 56.

Slider frame 82 comprises arms 84 and 86, and slider column 96. Arms 84 and 86 have respective ends 88 and 90 having respective lock tabs 92 and 94. Arms 84 and 86 extend substantially parallel to slider column 96. Lock tabs 92 and 94, however, extend inwardly from ends 88 and 90, respectively, toward slider column 96, without reaching slider column 96.

As best seen in FIG. 5, slider assembly 80 further comprises stopper member 98, spring post 100, and cavity 102. Cavity 102 extends from stopper member 98. Cavity 102 partially houses spring 70 therein. Stopper member 98 with spring post 100 and cavity 102 are positioned at slider column 96. Slider column 96 further has locking ramp 112, which protrudes from slider column 96. Locking ramp 112 has key cutout 114, best seen in FIG. 6.

As seen in FIG. 6, guide members 60 are positioned adjacent to lateral walls of spring channel 56. Guide members 60 extend from an interior of front wall 42 and protrude a predetermined distance beyond the lateral walls of spring channel 56. Locking tab 104 extends from slider frame 82 and is substantially parallel to slider column 96. Locking tab 104 comprises distal end 108 having notch 106. Cavity 110 is defined by locking tab 104 and slider column 96.

Cover plate assembly 120 has exterior face 122 and interior face 124. Cover plate assembly 120 comprises neck 126 that connects to transversal opening 128. Transversal opening 128 has notch 136 at interior face 124. Cover plate assembly 120 also comprises locator posts 130 and 132, key alignment hole 134, and stopper protrusion 138, all positioned at interior face 124. When lock assembly 20 is assembled, locator posts 130 and 132 fill holes 52 and 54 respectively. Also, key alignment hole 134 receives distal end 188 of key 180. Cover plate assembly 120 further comprises guide members 125 and ultrasonic weld energy director 140. Ultrasonic weld energy director 140 provides material to melt together with edge 47 during an ultrasonic welding process. It is noted that ultrasonic weld energy director 140 is a conventional procedure for designs requiring ultrasonic welding. As material melts upon ultrasonic heating, the mating parts, namely cover plate assembly 120 and edge 47, are welded together without needing additional adhesive. Guide members 125 are positioned adjacent to transversal opening 128. Guide members 125 extend from interior face 124.

Guide members 60 cooperatively slide between arm 84 and slider column 96, and arm 86 and slider column 96, respectively, when lock assembly 20 is assembled. In the same way, guide members 125 cooperatively slide between arm 84 and slider column 96, and arm 86 and slider column 96, respectively, when lock assembly 20 is assembled.

Key 180 has head 182, and shaft 184 with distal end 188, and bit 186. Bit 186 has a flat distal surface and an angled wall.

Figure 7A:
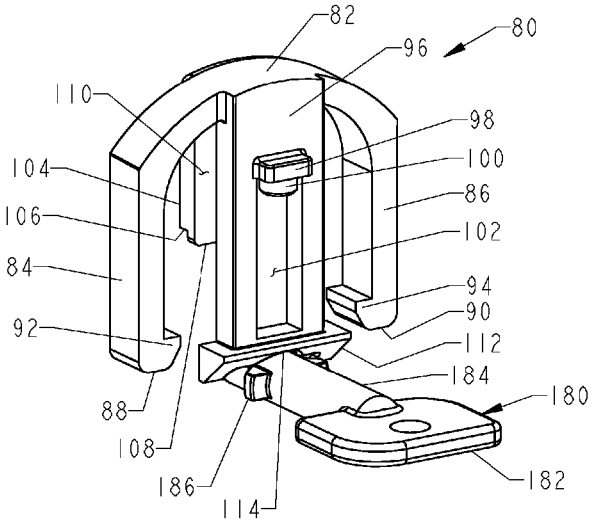
FIG. 7A is a first isometric view of a slider assembly with a key inserted through a keyhole.
Figure 7B:
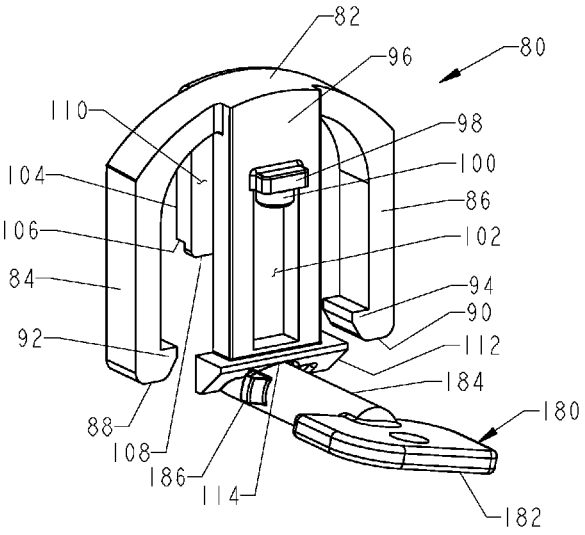
FIG. 7B is a second isometric view of the slider assembly seen in FIG. 11, with the key inserted through the keyhole and rotated.
Figure 8:
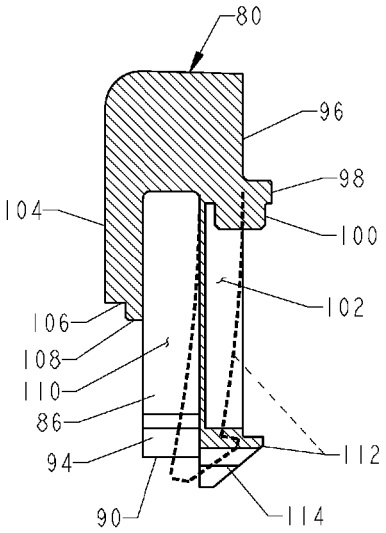
FIG. 8 is a cross section representation of the slider assembly, showing a displacement/deflect of the locking member as the key is inserted through the keyhole and rotated.

For illustrative purposes, in FIGS. 7A and 7B slider assembly 80 is represented with key 180, but without front housing 40 or cover plate assembly 120. Seen in FIG. 7A is slider assembly 80 in a position wherein lock assembly 20 is locked and key 180 has been inserted into keyhole 44, not shown, and key cutout 114. FIG. 7B shows slider assembly 80 wherein key 180, going through key cutout 114, is partially rotated. It is noted that, when key 180 rotates, the angled wall of bit 186 actuates against an angled wall of locking ramp 112 thus displacing/deflecting locking ramp 112 as shown in FIG. 8.

Figure 9A:
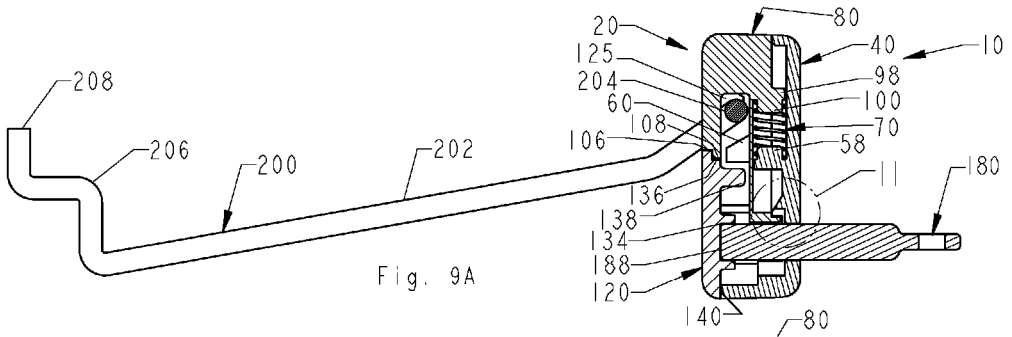
FIG. 9A is a first side view of the circular lock assembly in an upward orientation, mounted and locked onto a rail assembly with the key inserted through the keyhole. The circular lock assembly has been cross-sectioned to show its internal mechanism.
Figure 9B:
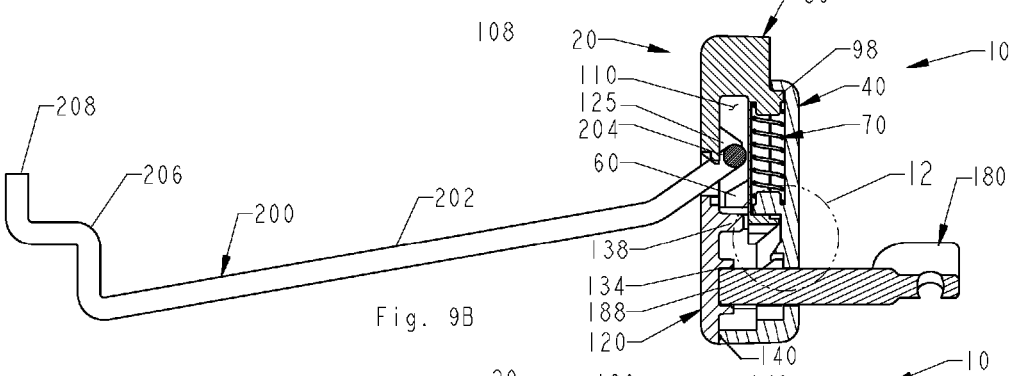
FIG. 9B is a second side view of the circular lock assembly seen in FIG. 9A, unlocked with the key inserted through the keyhole and rotated.

As seen in FIGS. 9A and 9B, rail assembly 200, being of a dual rail member configuration, includes parallel rail members 202 kept at a spaced apart relationship with respect to each other by transversal member 204. Rail members 202 have curvatures 206 and distal ends 208. A plurality of rail assemblies 200 are usually mounted to display racks in stores, not seen. Packaging comprising products, not seen, typically are suspended from rail members 202. As locking means, lock assembly 20 is mounted to transversal member 204 in a locked position to prevent removal of packaging suspended from rail members 202.

Figure 11:
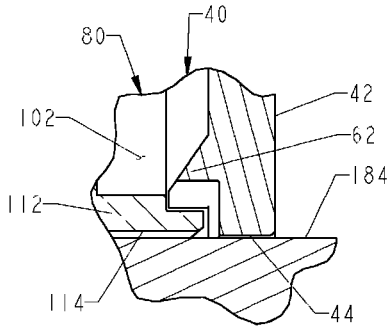
FIG. 11 is a first enlarged detailed view of the slider assembly partially represented, showing a locking mechanism in a locked position from FIG. 7A.

Seen in FIG. 9A is a cross section of circular lock assembly 10 mounted and locked to a rail assembly 200. In the locked position, locking ramp 112 is engaged to locking member 62, as best seen in enlarged portion shown in FIG. 11.

It is noted that spring 70 engages at one end to spring base 58, and to spring post 100 at the other end. Also, spring 70 is housed within spring channel 56 and cavity 102, which complement each other when lock assembly 20 is assembled.

It is also noted that, when lock assembly 20 is in a locked position, distal end 108 with notch 106 are received by notch 136 of transversal opening 128, as best seen in FIG. 9A.

Stopper protrusion 138 is intended to limit the deflection of slider column 96 when bit 186 actuates upon locking ramp 112 to release locking ramp 112 from locking member 62.

Figure 12:
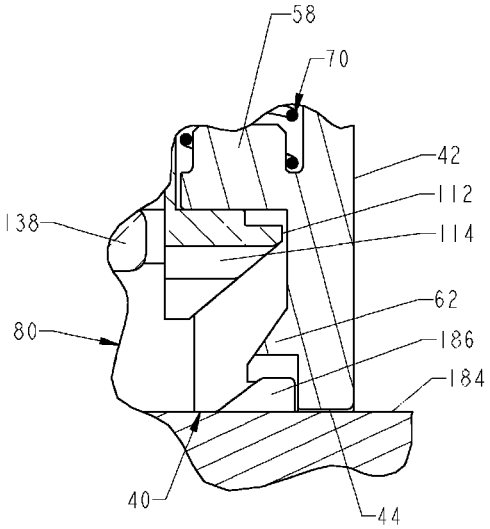
FIG. 12 is a second enlarged detailed view of the slider assembly, showing the locking mechanism in an unlocked position from FIG. 7B.

Seen in FIG. 9B is a cross section of circular lock assembly 10 mounted to a rail assembly 200 and key 180 is rotated. When a user inserts key 180 through keyhole 44 and starts rotating it, the distal flat surface of bit 186 contacts the horizontal surface of locking member 62, while the angled wall of bit 186 actuates against the angled wall of locking ramp 112 thus displacing/deflecting it, as mentioned before. Consequently, the flat/upper surface of locking ramp 112 is released from locking member 62. Once locking ramp 112 has been released from locking member 62 a force exerted by spring 70 pushes slider assembly 80, thus opening transversal opening 128, seen in FIG. 4, to allow the removal of circular lock assembly 10 from rail assembly 200. In the unlocked position as seen in FIGS. 9B and 12, locking ramp 112 has been released from locking member 62.

To lock locking assembly 20, transversal member 204 is inserted through transversal opening 128. Once in place, a force is placed upon protruding slider assembly 80 until locking ramp 112 overcomes locking member 62.

Figure 10A:
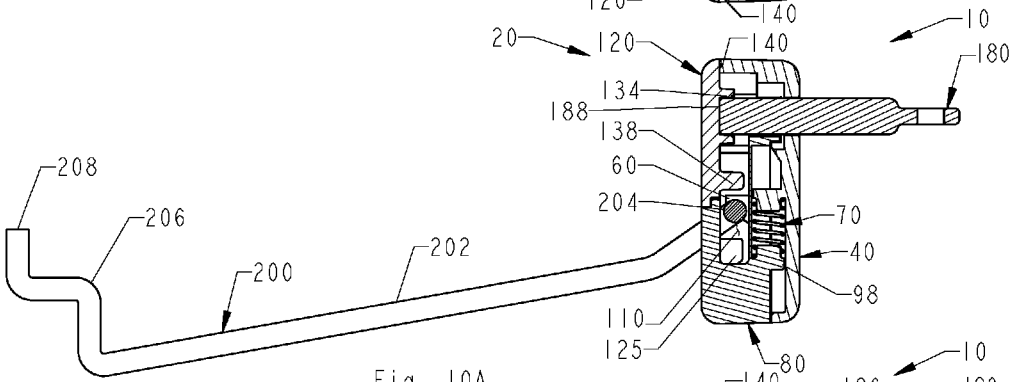
FIG. 10A is a first side view of the circular lock assembly in a downward orientation, mounted and locked onto a rail assembly with the key inserted through the keyhole. The circular lock assembly has been cross-sectioned to show its internal mechanism.
Figure 10B:
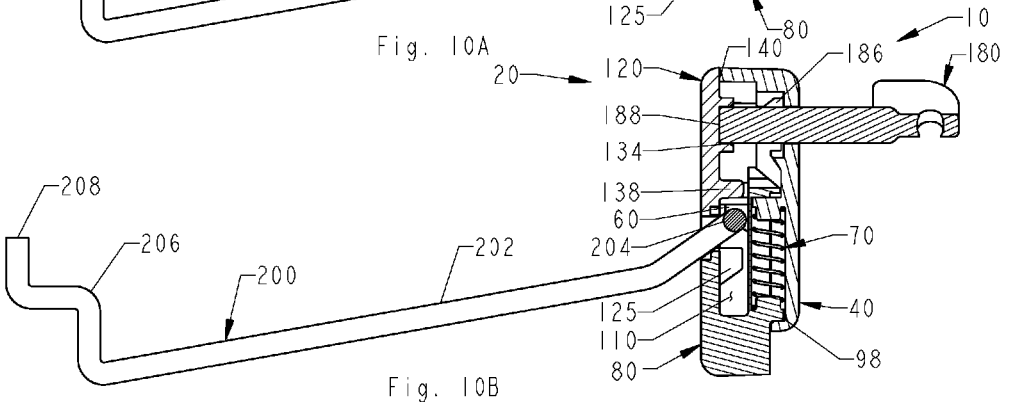
FIG. 10B is a second side view of the circular lock assembly seen in FIG. 10A, unlocked with the key inserted through the keyhole and rotated.

Circular lock assembly 10 can be mounted to rail assembly 200 in an upward configuration, as seen in figures in 9A and 9B, or in a downward configuration, as seen in FIGS. 10A and 10B. Locking assembly 20 works as described above in both positions.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lock assembly, comprising:

A) a front housing comprising a locking member and a keyhole, said front housing houses a spring;

B) a slider assembly comprising a slider frame, extending from said slider frame are first and second arms, said first and second arms each have a respective end and each said end has a respective lock tab, also extending from said slider frame is a slider column having a locking ramp at a distal end, said locking ramp is engaged by said locking member when said slider assembly is in a locked configuration, also extending from said slider frame is a locking tab;

C) a cover plate assembly comprising a transversal opening, said transversal opening receives a transversal member of a rail assembly when said slider assembly is in an unlocked configuration, said locking tab blocks said transversal opening when said slider assembly is in said locked configuration, securing said transversal member to prevent removal of packaging suspended from said rail assembly; and D) a key, once said key is inserted into said keyhole, said key is rotated against said locking ramp, causing release of said locking ramp from said locking member.

2. The lock assembly set forth in claim 1, further characterized in that said rail assembly comprises rail members kept at a spaced apart relationship with respect to each other by said transversal member.

3. The lock assembly set forth in claim 1, further characterized in that once said key is inserted into said keyhole, said key is rotated to cause said locking ramp to disengage from said locking member to place said slider assembly in said unlocked configuration.

4. The lock assembly set forth in claim 1, further characterized in that said spring is mounted onto a spring base of said front housing and onto a spring post of said slider assembly.

5. The lock assembly set forth in claim 1, further characterized in that said spring comprises a spring force to keep said slider assembly in said unlocked configuration.

6. The lock assembly set forth in claim 5, further characterized in that said spring force is overcome to place said slider assembly in said locked configuration.

7. The lock assembly set forth in claim 1, further characterized in that said slider assembly is positioned in between said front housing and said cover plate.

8. The lock assembly set forth in claim 1, further characterized in that said cover plate assembly comprises a key alignment hole to receive a distal end of said key.

9. The lock assembly set forth in claim 1, further characterized in that said cover plate assembly comprises a neck that extends from said transversal opening.

10. The lock assembly set forth in claim 9, further characterized in that said neck receives said locking tab to block said transversal opening when said slider assembly is in said locked configuration.

11. A lock assembly, comprising:

A) a front housing comprising a locking member and a keyhole, said front housing houses a spring;

B) a slider assembly comprising a slider frame, extending from said slider frame are first and second arms, said first and second arms each have a respective end and each said end has a respective lock tab, also extending from said slider frame is a slider column having a locking ramp at a distal end, said locking ramp is engaged by said locking member when said slider assembly is in a locked configuration, also extending from said slider frame is a locking tab;

C) a cover plate assembly comprising a transversal opening, said transversal opening receives a transversal member of a rail assembly when said slider assembly is in an unlocked configuration, said locking tab blocks said transversal opening when said slider assembly is in said locked configuration, securing said transversal member to prevent removal of packaging suspended from said rail assembly, said slider assembly is positioned in between said front housing and said cover plate; and D) a key, once said key is inserted into said keyhole, said key is rotated against said locking ramp, causing release of said locking ramp from said locking member to place said slider assembly in said unlocked configuration.

12. The lock assembly set forth in claim 11, further characterized in that said rail assembly comprises rail members kept at a spaced apart relationship with respect to each other by said transversal member.

13. The lock assembly set forth in claim 11, further characterized in that said spring is mounted onto a spring base of said front housing and onto a spring post of said slider assembly, said spring comprises a spring force to keep said slider assembly in said unlocked configuration.

14. The lock assembly set forth in claim 11, further characterized in that said spring force is overcome to place said slider assembly in said locked configuration.

15. The lock assembly set forth in claim 11, further characterized in that said cover plate assembly comprises a key alignment hole to receive a distal end of said key.

16. The lock assembly set forth in claim 11, further characterized in that said cover plate assembly comprises a neck that extends from said transversal opening.

17. The lock assembly set forth in claim 16, further characterized in that said neck receives said locking tab to block said transversal opening when said slider assembly is in said locked configuration.

* * * * *